US012655639B2

(12) United States Patent
Edscer et al.

(10) Patent No.: US 12,655,639 B2
(45) Date of Patent: Jun. 16, 2026

(54) BUILDING REINFORCEMENT WITH ADJUSTABLE CLADDING SUPPORTING FRAMEWORK

(71) Applicant: William George Edscer, East Sussex (GB)

(72) Inventors: William George Edscer, East Sussex (GB); John Grahame Marshall, Leicestershire (GB)

(73) Assignee: William George Edscer, East Sussex (GB)

( * ) Notice: Subject to any disclaimer, the term of this patent is extended or adjusted under 35 U.S.C. 154(b) by 197 days.

(21) Appl. No.: 18/285,044

(22) PCT Filed: Mar. 30, 2022

(86) PCT No.: PCT/GB2022/050790
§ 371 (c)(1),
(2) Date: Sep. 29, 2023

(87) PCT Pub. No.: WO2022/208074
PCT Pub. Date: Oct. 6, 2022

(65) Prior Publication Data

US 2024/0175269 A1 May 30, 2024

(30) Foreign Application Priority Data

Mar. 31, 2021 (GB) ..... 2104675
Jun. 3, 2021 (GB) ..... 2107935
Jul. 13, 2021 (GB) ..... 2110102

(51) Int. Cl.
*E04F 13/08* (2006.01)

(52) U.S. Cl.
CPC ..... *E04F 13/0808* (2013.01)

(58) Field of Classification Search
CPC ..... E04F 13/07; E04F 13/072; E04F 13/08; E04F 13/0801; E04F 13/0803;
(Continued)

(56) References Cited

U.S. PATENT DOCUMENTS 3,367,077 A * 2/1968 Johnston ..... E04B 2/96 52/468
4,060,951 A * 12/1977 Gere ..... E04B 2/94 52/235
(Continued)

FOREIGN PATENT DOCUMENTS

DE 4412505 C1 * 6/1995 ..... E04F 13/0814
EP 1310612 A2 5/2003
(Continued)

OTHER PUBLICATIONS

International Search Report and Written Opinion issued in corresponding International Patent Application No. PCT/GB2022/050790 mailed Jan. 7, 2022 (12 pages).
(Continued)

*Primary Examiner* — Kyle J. Walraed-Sullivan
(74) *Attorney, Agent, or Firm* — Kilyk & Bowersox, P.L.L.C.

(57) ABSTRACT

A method of reinforcing and optionally insulating a building is provided. A stronger and incrementally adjustable method of securing a metal framework of vertical and horizontal rails to an array of screw-threaded tie bar ends projecting from the outer wall of a high rise building. The method involves placing, over each projecting tie bar end, a fixing plate that has a profiled outer face. The bar end passes through a vertical or horizontal elongated slot formed in the fixing plate. A locking plate is placed over each projecting tie bar end and has a profiled inner face. The profiles of the inner face of the locking plate and the outer face of the fixing plate are complementary, allowing the two plates to mate
(Continued)

with each other in any of a number of alternative positions relative to each other.

10 Claims, 8 Drawing Sheets

(58) Field of Classification Search
CPC ..... E04F 13/0805; E04F 13/0807; E04F 13/0808; E04F 13/081; E04F 13/0814; E04F 13/0832; E04F 13/0846; E04F 13/0853; E04F 13/0855; E04F 13/0857; E04F 13/0862; E04F 13/09; E04F 13/21; E04F 13/22; E04F 13/23; E04F 13/24; E04F 13/25; E04F 13/26; E04F 13/28; E04B 2/88; E04B 2/90; E04B 2/96
See application file for complete search history.

(56) References Cited

U.S. PATENT DOCUMENTS 4,307,551 A * 12/1981 Crandell ..... E04F 13/0808 52/235
4,483,122 A * 11/1984 Crandell ..... E04F 13/0808 52/235
4,570,401 A * 2/1986 Uebel ..... E04F 13/0855 52/235
5,720,571 A * 2/1998 Frobosilo ..... E04B 2/96 403/231
5,846,018 A * 12/1998 Frobosilo ..... F16B 5/0225 403/231
8,468,765 B1 * 6/2013 Kim ..... E04F 13/14 52/510
2003/0150179 A1 * 8/2003 Moreno ..... E04F 13/0808 52/235
2010/0325997 A1 * 12/2010 Scully ..... E04F 13/0805 52/489.1
2014/0157699 A1 * 6/2014 Moeller ..... E04B 2/88 52/235
2015/0308098 A1 * 10/2015 Tessadori ..... E04B 2/7411 52/698
2018/0066424 A1 * 3/2018 Daudet ..... E04B 1/2403
2023/0304295 A1 * 9/2023 Jansen ..... E04B 1/7637

FOREIGN PATENT DOCUMENTS

FR 2849461 A1 * 7/2004 ..... E04F 13/0807
GB 1440784 A 6/1976
GB 2242211 A * 9/1991 ..... E04F 13/0857
GB 2242722 A * 10/1991 ..... E04F 13/0857
GB 2574092 A 11/2019
GB 2605817 A * 10/2022 ..... E04F 13/14
KR 200236821 Y1 10/2001
KR 101515937 B1 5/2015
KR 20200104535 A 9/2020
WO 9964692 A1 12/1999
WO WO-2004079127 A1 * 9/2004 ..... E04F 13/0808

OTHER PUBLICATIONS

Search report issued in corresponding United Kingdom Patent Application No. GB2110102.7 dated Sep. 22, 2022 (2 pages).

* cited by examiner

BUILDING REINFORCEMENT WITH ADJUSTABLE CLADDING SUPPORTING FRAMEWORK

FIELD OF THE INVENTION

The invention relates to improvements in a method of reinforcing and externally cladding a certain class of existing high rise modular building. The basic method is disclosed in our Patent No GB2574092, which describes the cladding as external wall insulation (EWI). As described in GB2574092, the buildings to be reinforced and insulated in this way are all concrete frame buildings, but the method is most advantageously applied to large panel system buildings. These are systems in which load-bearing precast concrete wall slabs are erected edge to edge, and topped with precast concrete floor/ceiling slabs which are secured edge to edge to the tops of the load-bearing wall slabs. Each floor/ceiling slab forms part of the ceiling of the storey defined by the interconnected wall slabs and part of the floor of the next higher storey of the building. The reinforcement provided by the method of GB2574092 is to reduce or eliminate the risk of disproportionate collapse of the building in the event of, for example, an internal gas explosion. The insulation is desirable to improve the thermal efficiency of the building, but must be carefully specified to avoid the risk of major fire spread such as that which occurred in the Grenfell Tower fire in the United Kingdom in 2017, when a fire swept upwardly through a tower block feeding principally, it is believed, through the external wall insulation ("EWI") panels that had been added as cladding over the external walls of the building.

GB2574092 teaches a method of securing EWI panels to the outer walls of a high rise concrete frame building. The method comprises first creating continuous passages through outer load-bearing wall panels of the building into adjacent floor/ceiling panels. Each such passage forms a tie bar anchorage hole extending at least 300 mm into the adjacent floor/ceiling panel. Into each tie bar anchorage hole there is inserted a tie bar which has at an inner end portion an anchorage received in the associated tie bar anchorage hole and which has at an outer end portion an externally screw-threaded portion which projects from the outer load-bearing wall panel. By a particular sequence of method steps specified in GB2574092 the tie bars are anchored in the tie bar anchorage holes with their externally threaded portions extending from the outer load-bearing wall panels, and then there is secured to the externally screw-threaded outer end portions of the tie bars a metal framework for supporting the EWI panels to be added as external thermal insulation cladding for the building. Finally those EWI panels are secured to the metal framework to clad the building.

The method of GB2574092 always commences in practice with a careful and detailed survey of the building and the creation of a detailed planning of the exact positioning of the tie bars to support the external metal framework which will ultimately support the EWI panels. GB2574092 addresses the importance of building the metal framework precisely, with extreme care being taken to establish the accuracy of the vertical and horizontal alignment and the exact spacing apart of channels formed in the metal framework to fit the size of the individual pre-formed external EWI panels. If the tie rods to which the metal framework is attached were to be positioned in perfect vertical and horizontal alignment and spaced apart to match precisely the size of the EWI panels to be supported, then the securing of the metal framework would be simple. Fixing plates such as that shown in FIGS. 10 and 14 of GB2574092 would be placed over the projecting ends of the tie bars and secured by nuts tightened to a predetermined torque rating.

In practice, however, the tie rods to which the metal framework is to be attached will be less than perfectly positioned, due either to human error in the drilling of the core holes for the pattress plates or to the deliberate repositioning of those core holes and tie rods to take account of specific features of the building being reinforced. Small inconsistencies in the vertical positions of some of the tie bars might be accommodated by having the mounting holes in the fixing plates elongate as shown in FIGS. 11 to 13 of GB2574092, to bring the final mountings for the metal framework into strictly accurate alignment. The possibility of larger inconsistencies in the layout of the tie bars is not however addressed in GB2574092.

If a small measure of adjustment both vertically and horizontally is required, then GB2574092 teaches the use of a composite fixing plate assembly as shown in FIGS. 14b to 14d of GB2574092, the fixing plate assembly comprising a number of eccentrically rotatable elements, rotation of different ones of which can be adjusted to move the actual fixing plates for the metal framework into an exactly regular vertical and horizontal array to match precisely the size of the EWI panels to be mounted thereon. These solutions of FIGS. 14b to 14d of GB2574092 are however expensive and suffer from the disadvantage that they permit only a small amount of adjustment.

GB2574092 also teaches the use of a combination of fixing plates and locking plates to make small adjustments to the locations of brackets which attach the vertical or horizontal PFC rails of the support framework to marginally misaligned tie bars, and teaches that after each pair of such plates is adjusted to the correct position they should be clamped together by tightening to a desired torque rating the nuts threaded onto the projecting ends of the tie bars. If additional security to prevent movement of the locking plates relative to the fixing plates is desired, then GB2574092 teaches that holes or slots should be drilled or milled on-site through each pair of clamped together fixing and locking plates, and dowels or other retainers inserted in those on-site drilled holes or slots to bridge across the fixing and locking plates in order to maintain the accurate positioning of the fixing and locking plates. On-site drilling or milling is, however, undesirable when working from high level scaffolding positioned against the outer wall of the building being reinforced. There is therefore a need for a better method of adjusting the positioning of brackets to support the external metal framework to be attached to the projecting ends of even marginally misaligned tie bars.

In addition to the potential need for small adjustments to the vertical and horizontal positioning of the external metal framework to be attached to the projecting ends of the tie bars, the situation may even be worse than that discussed in GB2574092, because the positioning of some of the tie bar anchorage holes may have been deliberately offset by significant distances to avoid particular features associated with the building being reinforced. In general those significant and deliberate departures from a totally uniform and consistent spacing of the tie bars will be a departure from a regular horizontal spacing, attributable to specific features of the building identified during the initial on-site structural survey. For example there may have been scaffolding rails set up on-site as a first step in the building reinforcement operation, obstructing the desired optimal positions of one or more of the tie bars; or there may be pre-existing building features such as the vertical masts set against some buildings to support and guide mast climbing platforms used for the external maintenance of the building. In those circumstances some of the tie bar anchorage holes would have been drilled well out of line with the ideal locations and spacing to match the size and shape of the EWI panels to be secured to the outside of the building, and the fixing plates for supporting and securing the metal support framework to the tie bars must therefore be designed with significant adjustability to bridge that offset, well in excess of the limited adjustability contemplated in GB2574092.

This invention follows the same sequence of inserting tie bars into the concrete frame building and mounting a metal framework on the external protruding ends of the tie bars. The external panels to be supported by that metal framework may be EWI panels as in GB2574092 or any other feature panels, such as rain screen panels or feature panels with or without thermal insulation properties. This invention addresses the twin problems of providing an adjustable mounting for the metal support framework in order to ensure that the support framework is erected closely to match the dimensions of the feature panels even when the projecting ends of the tie bars are not correctly aligned, and providing a mounting which has a significantly increased strength to prevent or reduce the risk of disproportionate collapse of the building in the case of, for example, an internal explosion that might cause damage to one or more outer wall panels. The combination of substantial adjustability and increased strength is a very valuable combination of features that was not envisaged in GB2574092. Furthermore, whereas the issue of adjustability was dealt with in GB2574092 on the basis that any adjustment must be totally continuous, this invention is predicated on the realization that incremental adjustment is perfectly acceptable and can be designed to lead to increased strength.

SUMMARY OF THE INVENTION

The invention provides the method of claim 1 herein. The method can be considered as comprising four main stages:

(1) placing a fixing plate over the end of each projecting tie bar, with the tie bar passing through a vertical or horizontal elongate slot in the fixing plate. This permits the fixing plate to be moved slidably relative to the tie bar end, to a position that is in a desired vertical or horizontal alignment corresponding to the precise size and intended location of the metal framework to support the feature panels to be secured to the building.

(2) placing a locking plate over the end of each projecting tie bar, with the tie bar passing closely through a circular hole in the locking plate. The fixing plates are prevented from further sliding movement relative to the tie bars by cooperating profiles of the contacting faces of the fixing and locking plates. Those cooperating faces may be, for example, corrugated or ridged faces of the two plates, or a dowel connection between the fixing plates and locking plates, with one or more dowels on one of each pair of plates being received in a selected one or more dowel receiving holes in the other of the pair of plates. The selection of which dowel receiving hole or holes accept or accepts the dowel or dowels determines and fixes the position of each fixing plate relative to its tie bar. If the dowel holes are pre-formed in the fixing or locking plate as an array of spaced apart dowel holes the adjustment of the alignment of the fixing plate is incremental, the increments being dictated by the spacing apart of the dowel holes in the array. Those increments should be small enough to allow adequately accurate alignment of the metal framework. It has been found that adjustment increments of about 15 mm should be sufficient, since any discrepancies less than 15 mm between the spacing apart of the vertical or horizontal elements forming the metal framework and the actual size of the pre-formed EWI panels can be accommodated by the depth of the channels in the metal framework which will ultimately receive and support the feature panels. If smaller increments in the adjustment of the fixing plates relative to the tie bars are called for, then the cooperating profiles of the fixing and locking plates are preferably complementary corrugations creating regular parallel ridges and troughs which interfit with one another as the two plates are drawn together. Such parallel corrugations may reduce the adjustment increments of the fixing plates relative to the tie bars to as little as from 1 mm to 2 mm.

(3) securing together each pair of fixing plate and associated locking plate by threading a holding nut onto the projecting end of the tie bar and tightening that holding nut against the locking plate, the holding nut thus holding the fixing and locking plates against the outer wall of the building. Preferably the holding nut is tightened to a predetermined desired torque rating, but even if that torque rating is not achieved (or is partially released in use for example by damage to the building itself) no sliding of the fixing plate out of alignment is possible because of the dowel or other profile connection between the fixing and locking plates. Preferably a locking nut is threaded onto the outer end of each tie bar and tightened against the holding nut.

(4) finally the vertical or horizontal rails of the metal framework are secured to the fixing plates or locking plates by an array of bolts connecting each vertical or horizontal rail to each fixing plate. The fixing plates are immovable relative to the tie bars in at least one direction because of the cooperating profile interconnection between the fixing plates and the locking plates, and the metal framework is immovable relative to the tie bars by the plurality of bolts connecting each element of the framework to each of the fixing or locking plates. In the remainder of this specification the vertical or horizontal rails of the metal framework are described as being secured to the fixing plates in this final step of the invention, but it will be understood that securing those rails to the locking plates has an entirely analogous effect.

Fire safety considerations may demand that the vertical or horizontal rails of the metal framework are held against the exterior of the building without any gap therebetween, which means that one of those rails has an outer face which is flush with or lies behind the profiled outer face of the fixing plate. That can be achieved by profiling an outer facing surface of that rail to cooperate with the complementary profiled inner face of the locking plate, so that the profiled rail itself becomes the fixing plate. If that profiled rail is a universal beam such as a preformed I-beam or a composite I-beam formed by a pair of back-to-back parallel formed channels (PFCs) then the I beam may be cut away to allow only its inner flange to present the profiled outer face of the fixing plate. That profile may be formed directly in the outer face of the universal beam, for example by drilling dowel receiving holes in that inner flange, or it may be formed for example as corrugations on a plate of metal or other strong and fire-resistant material secured to the inner flange.

The cooperating profiles of the fixing and locking plates may secure the plates and thus the external metal framework against movement in the vertical and horizontal directions or against movement in only one of those directions. For example cooperating dowels and dowel receiving holes in the two plates provides security against unwanted movement in both directions, but cooperating corrugations may permit movement in one direction only, parallel to the corrugations. Movement in that one direction may be prevented by having the elongate slot in the fixing plate substantially the same diameter as the tie bar, so that movement perpendicular to the length of the slot is impossible and movement in the direction of the length of the slot is allowed during assembly but prevented by the fixing and locking plates after the holding nut is tightened. In some circumstances however movement in both directions may be desirable during assembly, for example when the tie bars are out of precise alignment both horizontally and vertically. In such circumstances the slot should be made wider than the diameter of the tie bar, permitting adjustment during assembly both horizontally and vertically. On tightening the holding nut on the tie bar, movement in one direction (horizontal or vertical) is prevented by the cooperating corrugations of the holding plate and locking plate, and movement on the perpendicular direction may be prevented as in GB2574092 simply by the force applied to the holding nut which is tightened to a predetermined torque limit. A suitably designed fixing plate can, however, provide adjustability and secure locking in both directions. Such a suitably designed fixing plate is formed in two parts: an inner and an outer plate portion. If the inner face of the outer portion of the fixing plate is provided with corrugations in one direction (for example vertical) to cooperate with corrugations on the outer face of the inner portion of the fixing plate, then the outer face of the outer portion of the fixing plate is provided with corrugations in the perpendicular direction to cooperate with matching corrugations on an inner face of the locking plate itself. The tie bar passes through an enlarged hole or cut-away portion in both portions of the fixing plate, finally passing closely though the circular hole in the locking plate. On tightening the holding nut all sliding movement in directions transverse to the corrugations is prevented and the external metal framework can be secured to the building with no further risk of movement.

DRAWINGS

The invention is illustrated by the drawings of which:

FIG. 1 is a perspective view of a fixing plate and a locking plate having complementary angular corrugations on their mating faces, the fixing and locking plates being fitted in use over the end of a tie bar which projects from the outer wall of a concrete frame building. During fitting the fixing plate can be adjusted to a selected one of a number of discrete vertical positions and locked securely at that selected position by the locking plate.

FIG. 2 is a perspective view of another fixing plate and locking plate having complementary dowels and dowel receiving holes on their mating faces, the plates being fitted in use over the end of a tie bar which projects from the outer wall of a concrete frame building. As with FIG. 1, during fitting the fixing plate can be adjusted to a selected one of a number of discrete vertical positions and locked securely at that selected position by the locking plate.

Figure 8:
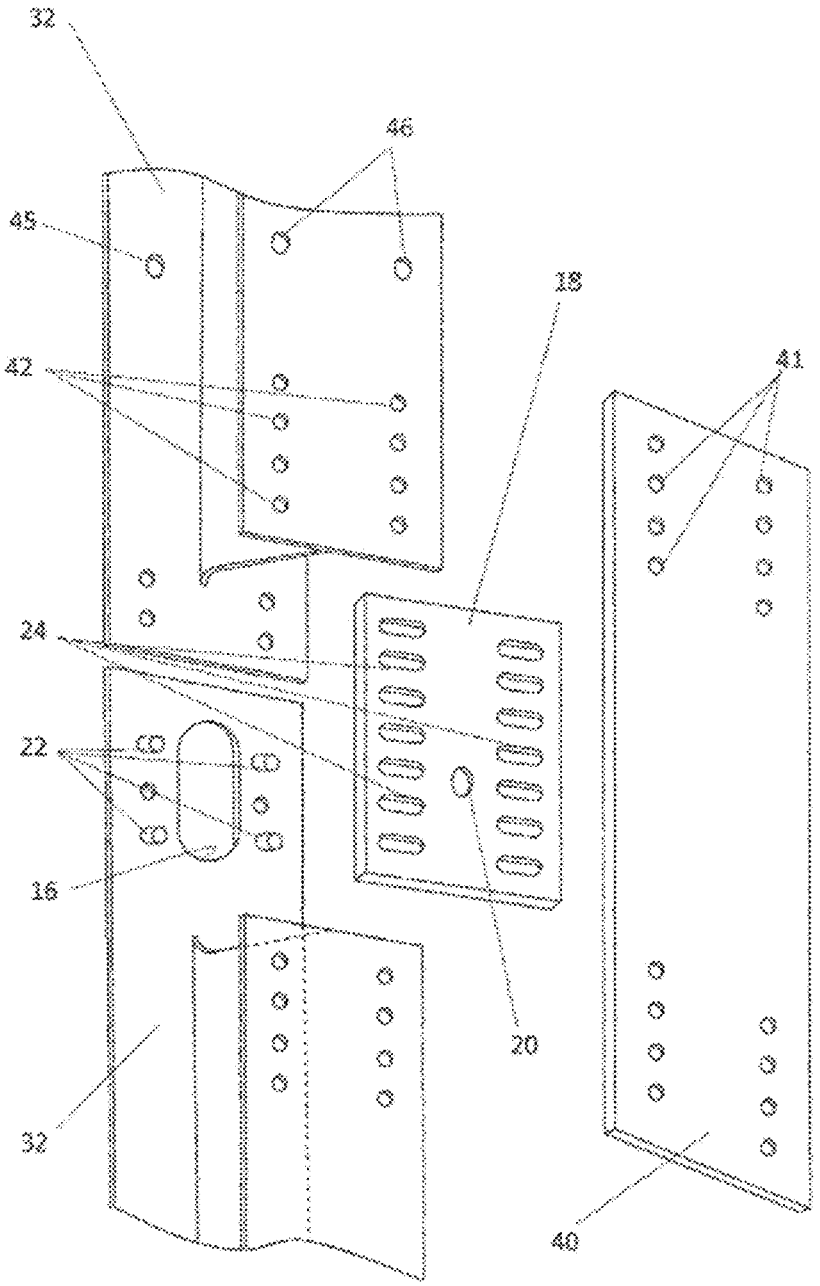
FIG. 8 is a perspective view of a fixing plate and locking plate similar to that of FIG. 2, except that the fixing plate is an integral part of the lower one of a pair of upper and lower universal beams which form vertical rails of the metal framework being attached to the external wall of a building. The horizontal rails that are fixed to that fixing plate are not shown.
Figure 9:
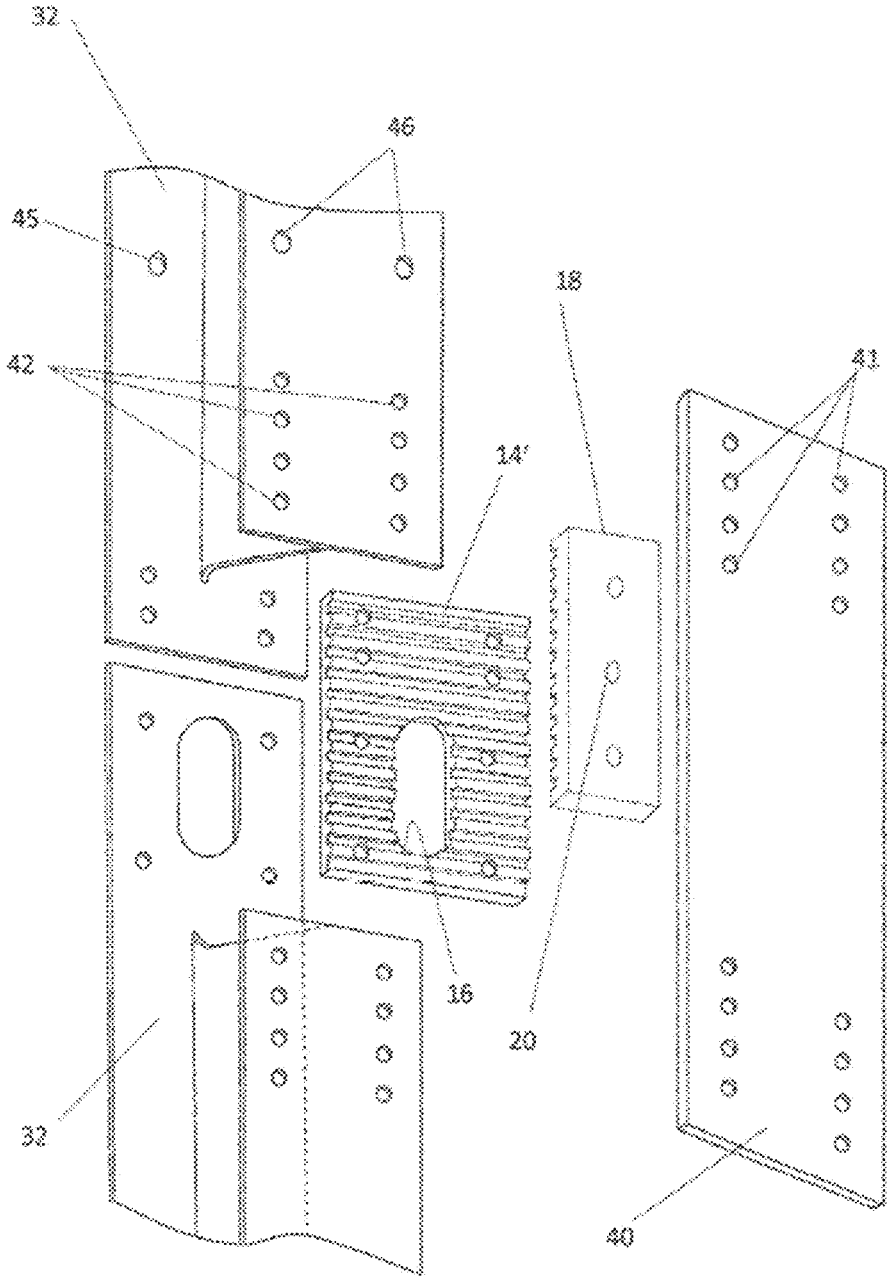

FIG. 9 is a perspective view similar to that of FIG. 8, where instead of dowels forming the profiled outer face of the fixing plate and dowel receiving holes forming the profiled inner face of the locking plate, corrugations form those profiled faces. In FIG. 9 the fixing plate is formed separately from the lower one of the universal beams but is secured fast to that universal beam before assembly.

Figure 10:
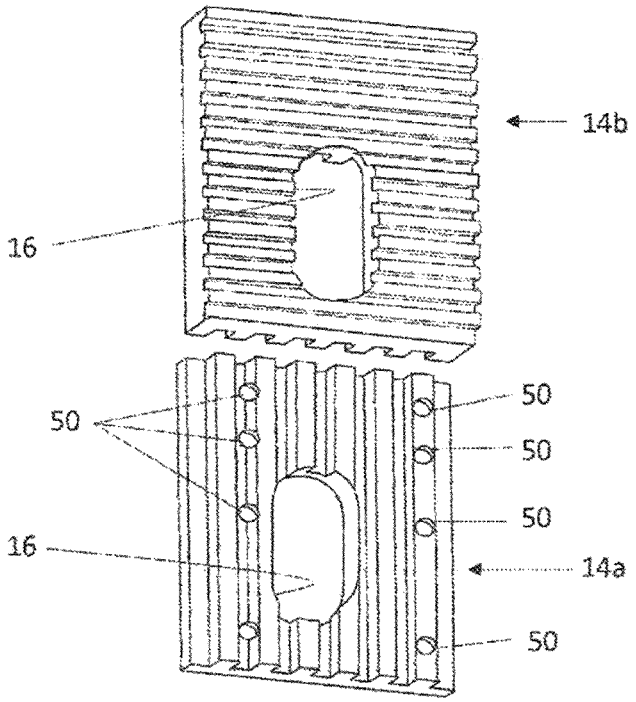

FIG. 10 is a perspective view of a composite fixing plate with inner and outer portions, having corrugations on the inner and outer portions running in mutually transverse directions The distribution of tie bars 12 over the building outer walls is carefully planned after a preliminary structural survey of the building as explained in GB2574092. That distribution is dictated in part by the size and shape of the feature panels that will be used to clad the exterior of the building, and in part by the building features and dimensions as measured in that preliminary survey. However in practice some or even all of those tie bars 12 will not be in the correct alignment with anchor points for the external metal framework to be attached to the building to support those feature panels. Sometimes the lack of alignment will be to a minor extent, due simply to human error in the accuracy of the positioning of the holes initially drilled through the outer wall of the building. At other times the inaccuracies may be because those initial holes have been deliberately offset to enable the tie rods to be aligned with voids in the floor/ceiling panels of the building. The greatest offsets between the protruding tie bar ends 12 and the edges of the feature panels may however be when the initial holes to receive the tie rods have had to be moved horizontally for perhaps significant distances to avoid specific building features such as scaffolding erected to facilitate the renovation and building reinforcement, or to avoid the vertical masts set against some buildings to support and guide mast climbing platforms used for the external maintenance of the building.

Figure 1:
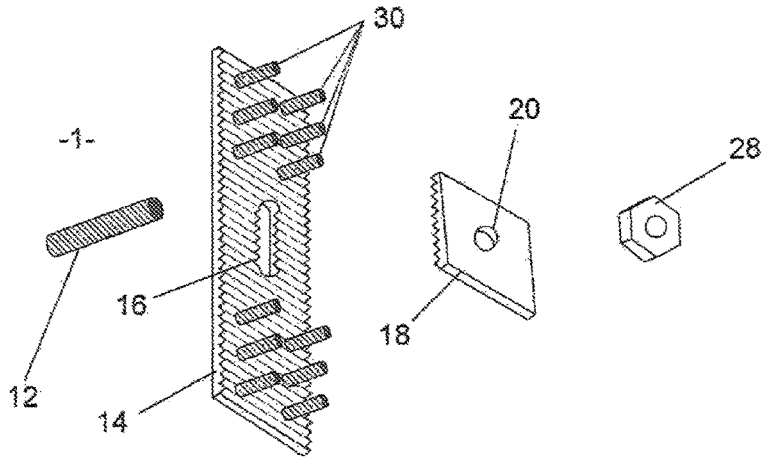

Referring first to FIG. 1, there is shown a screw-threaded end of a protruding tie bar 12 such as one of the tie bars of GB2574092 extending perpendicularly out from the outer wall 1 of a high rise building which is being strengthened and externally clad according to the method of GB2574092. Always it is necessary to secure to the protruding tie bars a metal channel framework which ultimately will receive in those channels the edges of the feature panels, and FIG. 1 illustrates how a fixing plate for supporting a metal channel framework can be adjusted vertically to bring it into alignment with other fixing plates as it is secured to the protruding tie bars according to this invention.

In FIG. 1 a fixing plate 14 with a vertical elongate slot 16 therein is placed over the end of each protruding tie bar 12, the tie bar 12 passing through the slot 16. It will be seen how the fixing plate 14 may be raised or lowered relative to the external wall of the building, with the tie bar 12 traversing the length of the slot 16. A locking plate 18 is placed against the fixing plate, with the tie bar 12 passing closely through a hole 20 formed in that locking plate 18.

The outer face of the fixing plate 14 and the inner face of the locking plate 18 are both corrugated, with angular corrugations having been formed therein by milling or pressing during manufacture. The corrugations in the two plates are complementary, and allow the fixing plate 14 to be locked by the locking plate 18 at any of a discrete number of vertical positions as dictated by the size of the corrugations. After adjustment of the height of the fixing plate 14 to bring it into a suitable alignment with other fixing plates to be attached to other tie bars, the fixing plate 14 is locked at that desired position by threading a holding load nut 28 onto the protruding end of the tie bar 12. That load nut 28 should preferably be tightened to a predetermined torque rating, but unlike the tightening of a similar holding nut in GB2574092 the rigidity of the mounting of the fixing plate 14 is not dictated by the torque applied to the load nut 28. Preferably a locking nut (not shown) optionally with a central secure locking pin is added to increase the strength of the mounting. The resistance to vertical movement of the fixing plate after the load nut 28 is applied is dictated by the complementary mating of the profiles of the fixing and locking plates. The strength of the mounting is very substantially greater than one relying on the proper tightening of the holding load nut alone as in GB2574092, and that increased strength permits the length of the elongate slot 16 to be much longer than comparable slots envisaged in GB2574092. During fitting the fixing plate has been adjusted to a selected one of a number of discrete vertical positions and locked securely at that selected position by the locking plate, and surprisingly the discrete nature of the vertical adjustment permitted by the mating profiles of the fixing and locking plates 14 and 18 is not an issue detracting from the ability of the attached metal framework to mount EWI panels used to clad and insulate the building. Adjustment increments of from 1 to 2 mm are possible according to FIG. 1, depending on the size and spacing of the corrugations formed in the fixing and locking plates 14 and 18.

Figure 2:
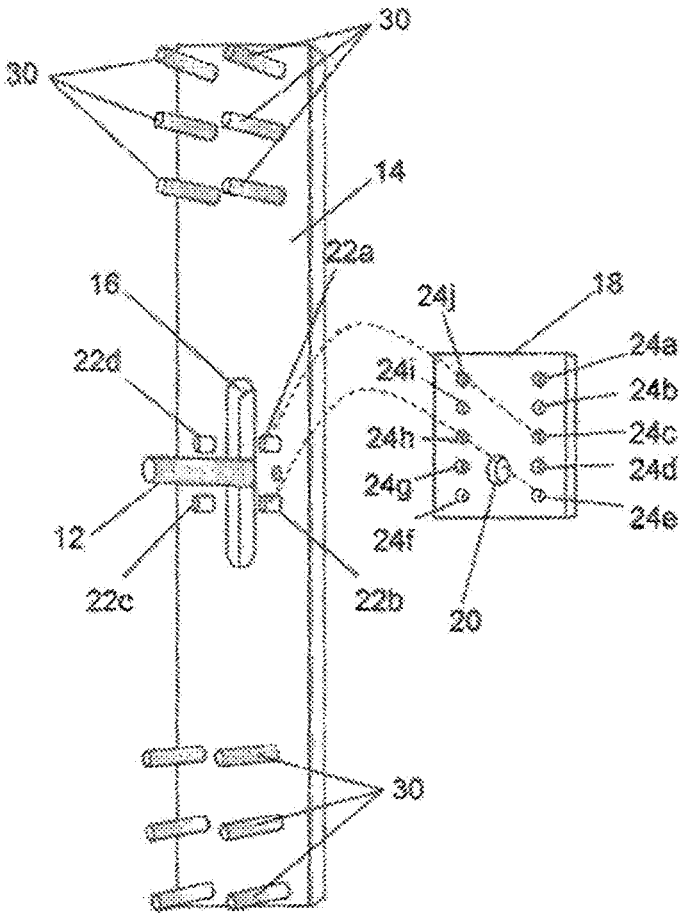

FIG. 2 shows an alternative profiling of the fixing and locking plates 14 and 18. In FIG. 2 four dowels 22*a* to 22*d* project outwardly from the fixing plate and are receivable in holes 24*a* to 24*j* in the locking plate. There are ten such holes illustrated, and which of the holes 24*a* to 24*j* are engaged by the dowels 22*a* to 22*d* dictates the height of the fixing plate 14 relative to the tie bar 12. FIG. 2 shows how by selection of the dowel holes to receive the dowels 22*a* to 22*d* the fixing plate 14 may be adjusted relative to the tie bar 12 at three different levels. By turning the locking plate 18 over to the orientation shown in FIG. 3, two further levels of mounting may be achieved. The different levels of mounting are spaced apart in small regular increments which may be 15 mm or less, which is sufficient for secure mounting of EWI panels in the channels of the metal channel framework which will be attached to the building to support the feature panels.

Figure 3:
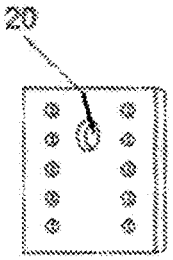
FIG. 3 is a perspective view of the locking plate of FIG. 2 after it has been inverted to extend the range of vertical increments over which the fixing plate can be adjusted.

In FIGS. 2 and 3 the hole 20 which closely receives the tie bar 12 is formed on the vertical centreline of the locking plate 18, equidistant between the two rows of dowel holes 24*a* to 24*i*; but if the slot 16 in the fixing plate 14 were wider than the diameter of the tie bar 12 to allow lateral movement of the fixing plate 14 relative to the tie bar 12, and if that hole 20 were offset in either direction from the vertical centreline of the locking plate 18, then rotation of the locking plate to reverse and invert that offset would permit a further level of adjustability by locking the fixing plate 14 relative to the tie bar 12 in either one of two horizontal locations. That extra level of horizontal adjustability may be achieved either in addition to or as an alternative to the extra level of vertical adjustability described above with reference to FIG. 3. Thus when the circular hole in the or each locking plate is positioned asymmetrically relative to the dowels or dowel receiving holes, inversion of that locking plate permits a further element of vertical or horizontal adjustability of the final positioning of the corresponding fixing plate relative to its tie bar.

Midway between the dowels 22*a* and 22*b*, and midway between the dowels 22*c* and 22*d*, are pre-drilled and tapped holes 26 in the fixing plate 14 which can receive holding screws (not shown) which pass through the aligned holes 24 in the locking plate 18 for a more secure locking together of the fixing and locking plates in any of their five alternative alignment positions.

Figure 4:
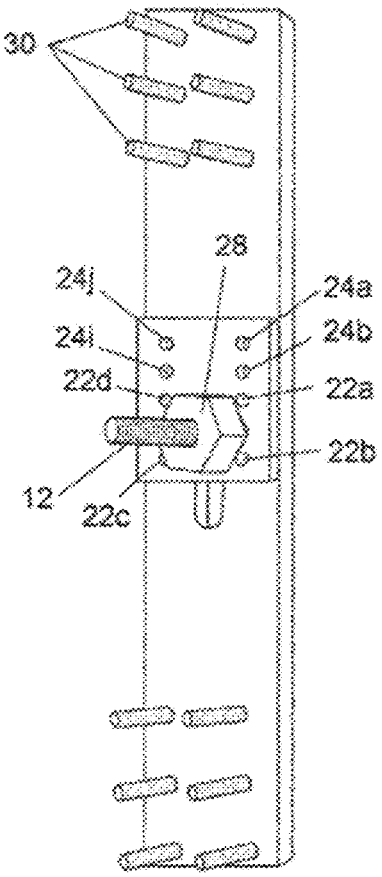
FIG. 4 is a perspective view of the fixing plate and locking plate of FIG. 2 after the locking plate has been secured over the fixing plate by a holding nut, with the dowels of the fixing plate being received in selected ones of the dowel holes of the locking plate.

If the locking plate 18 is aligned with the fixing plate 14 with the dowels 22*a* to 22*d* engaging the holes 24*c*, 24*e*, 24*f* and 24*h* as indicated in broken lines in FIG. 2 and with the holding screws passing through the holes 22*d* and 24*g* into the holes 26, the fixing plate 14 is held in the alignment position shown in FIG. 4. A load nut 28 is screwed onto the threaded end of the tie bar 12 and tightened against the locking plate 18 to a predetermined torque rating. Preferably a locking nut (not shown) optionally with a central secure locking pin is added to increase the strength of the mounting.

The assembly is such that the fixing plate 14 has been secured to the external wall of the building at a selected one of five alternative incremental vertical positions relative to the tie bar 12. Retention of the fixing plate 14 in that position is most secure, since it is held by the load nut 28, the locking nut (if provided), the holding screws and the four dowels 22*a* to 22*d*. The strength of that retention is well in excess of expected dislodgement forces that may occur during or following major damage to the building. The dowels 22*a* to 22*d* and the holding screws would all have to shear before the fixing plate 14 could be displaced. Although not illustrated, an even stronger mounting may be obtained by providing edge flanges down one or both vertical edges of the locking plate 18, to engage against one or both of the corresponding vertical side edges of the fixing plate 14, reinforcing the dowel connection between the two plates by providing an additional abutment to resist horizontal movement of the fixing plate 16 relative to the locking plate 18.

Figure 5:
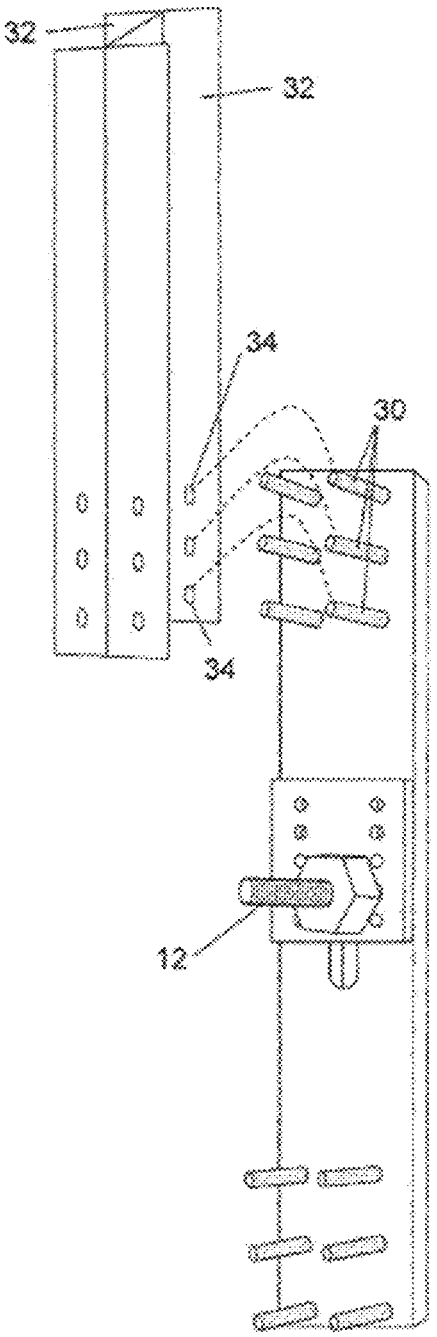
FIG. 5 is a perspective view of the fixing plate and locking plate of FIG. 4 showing how a vertical rail of an associated metal framework can be connected to the fixing plate by an array of bolts.

FIG. 5 illustrates how a vertical rail of a metal framework is attached to the fixing plate 14. The fixing plate 14 illustrated in FIG. 5 is that of FIG. 2, but the same principle of attachment would apply to the fixing plate 14 of FIG. 1. At each of the top and bottom of the fixing plate 14 there is provided a 3×2 array of bolts 30. FIG. 5 shows the lower end of a vertical rail which comprises a pair of back-to-back parallel formed channels (PFCs) 32. The vertical rail has a similar 3×2 array of holes 34 (three in each PFC 32) so that the vertical rail can be placed over the array of bolts 30 and held in place by nuts (not shown). Broken lines in FIG. 5 show which bolts 30 pass through which holes 34 when the vertical rail is attached to the fixing plate 14.

The horizontal rails of the metal framework are not illustrated but may be attached to the vertical rails as described in GB2574092.

Figure 6:
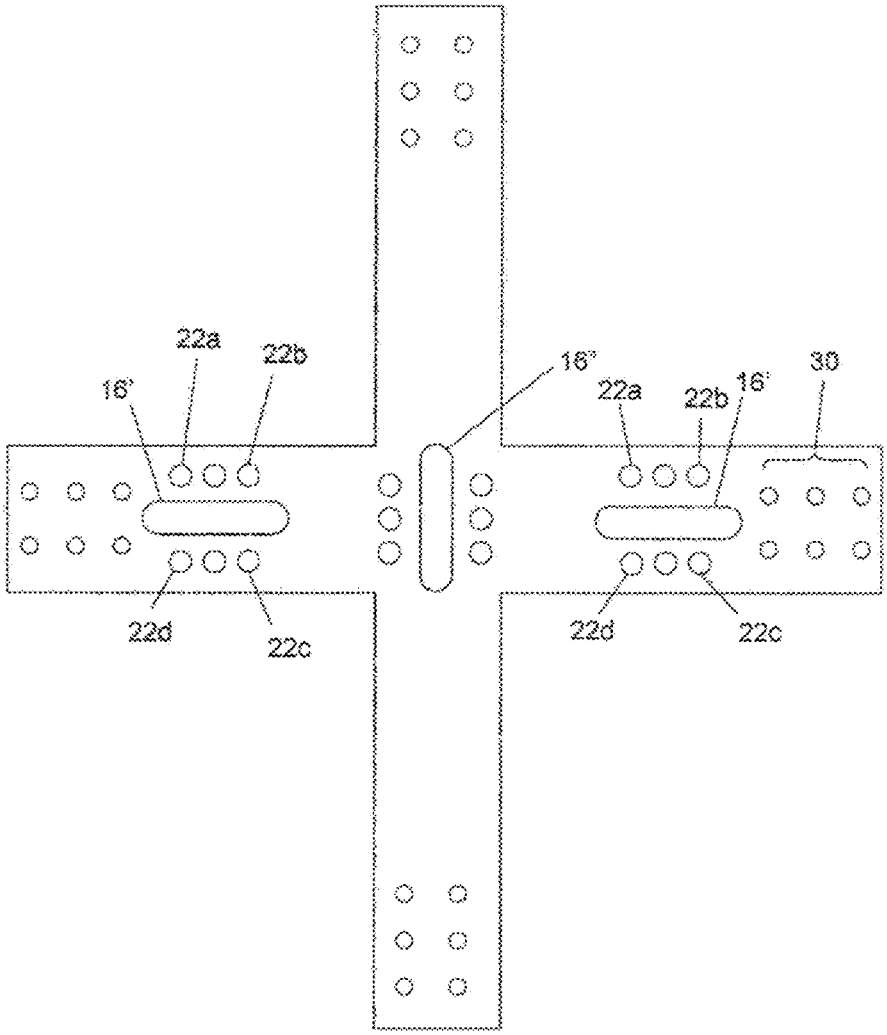
FIG. 6 is a plan view of an alternative fixing plate with wings for the horizontal adjustment of the fixing plate using the locking plate of FIG. 2.

The above description explains how vertical adjustment of the vertical rails of the metal framework which ultimately supports the feature panels may be achieved. Clearly the elements described could be rotated through 900 to obtain a similar horizontal adjustability of the mounting points for the vertical rails. The need for horizontal adjustability may however be much greater than the vertical adjustability because the tie bars may be significantly out of alignment in the horizontal direction. The core holes drilled to accommodate the tie bars 12 are in general drilled from horizontally aligned platforms and follow horizontally aligned floor/ceiling panels of the building, so that departures from a perfectly horizontal alignment are likely to be due to human error in the accurate drilling of the core holes which according to GB 2574092 determine the positioning of the tie bars 12. The horizontal spacing apart of the tie bars may however involve offsets by significant distances to avoid building features or temporary scaffolding structures. FIG. 6 illustrates a shape of fixing plate 14 which may be used to accommodate such misplaced tie bars 12. The fixing plate 14 of FIG. 6 has three elongate slots 16 in place of the single slot 16 of FIG. 1. Two are horizontal elongate slots 16' in laterally extending wings of the fixing plate 14, while the third is a vertical slot 16" formed in the central vertical portion of the fixing plate 14. For vertical adjustment of the fixing plate relative to a tie bar 12 the vertical slot 16" is used, while for horizontal adjustment one or both of the horizontal slots 16' is or are used and the vertical slot 16", which would then be redundant, may even be omitted during fabrication of the fixing plate 14.

If the position of a tie bar 12 has had to be significantly offset to avoid a vertically extending obstruction such as temporary scaffolding or a mast of a mast climbing platform, then for maximum strength that tie bar should preferably be supplemented by another tie bar on the opposite side of the obstruction, which is why FIG. 5 shows two horizontal elongate slots 16'. Both may be used to secure the single fixing plate, with one tie bar extending through each slot 16' and both being secured with locking plates 18 held in place by dowels as in FIGS. 2 to 4. The laterally extending wings of the fixing plate may be the same length as each other, as illustrated, or of mutually different lengths. The horizontal slots 16' are spaced to correspond to the spacing of the tie bars extending from the building outer face. The lengths of the wings and the positions of the slots 16' are chosen to match the distance through which the tie bars are displaced to avoid building features or temporary scaffolding structures, and if those wings extend for a sufficient length to make additional connections to the building desirable, then additional slots for receiving additional tie bars may be included.

Figure 7:
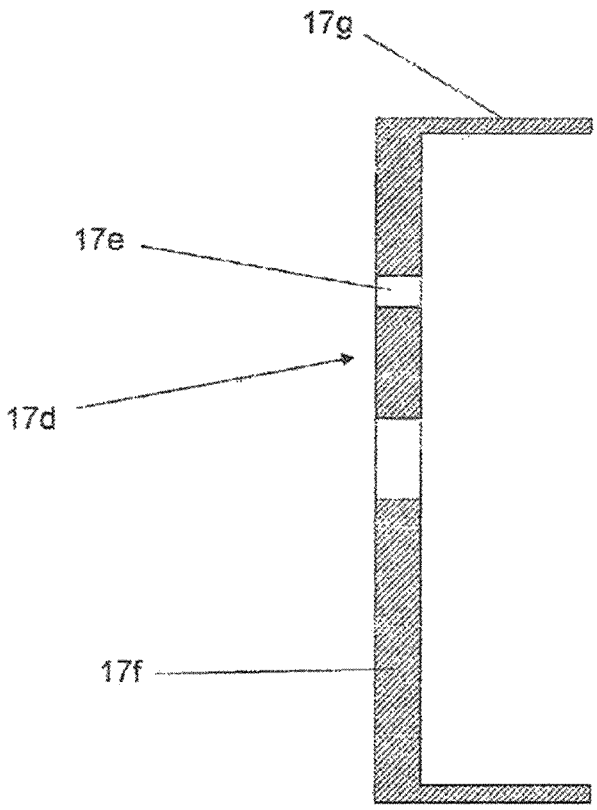
Fig 7 (PRIOR ART)
FIG. 7 is a section through a modified outer element of a composite pattress plate as described in GB2574092, which composite pattress plate may be used in the method of GB2574092 to secure a tie bar 12 to the building, in preparation for the securing of the metal framework according to this invention.

GB2574092 describes, with reference to FIG. 7*b*, how the pattress plate 17 through which the tie bar 12 passes (GB2574092 references used) can be a composite pattress plate formed from two components 17*a* and 17*d*. GB2574092 describes how the inner pattress plate element 17*a* can be held in place by an inner load nut (not illustrated in GB2574092) while the outer pattress plate element 17*d* is spaced apart from the inner element by a tubular cylindrical metal spacer 17*b* and a shim washer 17*c*. We now disclose an alternative method of adjusting the spacing apart of the two pattress plate elements 17*a* and 17*d* of GB2574092, which is preferred when adjusting the position of the outer pattress plate element 17*d* to bring it perfectly into line with the fixing plate 14 of this invention. The inner pattress plate element 17*a* is secured in place as described in GB2574092 and its inner load nut kept in place. The outer pattress plate element 17*d* is then fitted over the threaded outer end of the tie bar 12 and the fixing plate 14, locking plate 18 and holding load nut 28 are placed in position. After the vertical rail of the external framework is attached to a number of vertically aligned fixing plates along its length it is carefully checked to ensure that it is held by the tie bars 12 without pressure against the external concrete wall of the building, and the holding load nuts 28 lightly tightened to hold that vertical rail in position. When it has been established that the vertical rail does not press anywhere against the outer face of the building, grout is extruded through the grout extrusion hole (illustrated but unreferenced in GB2574092 and illustrated and given the reference number 17*e* in FIG. 7 of this specification, to be described later) formed in each outer pattress plate element 17*d* into the space between the inner and outer pattress plate elements. The extrusion pressure causes the outer pattress plate element 17*d* to move outwardly until it abuts the fixing plate 14, without the need for the tubular cylindrical metal spacer 17*b* and shim washer 17*d* of GB2574092. When the grout has set, the holding load nuts 28 are tightened further to a final predetermined torque rating. In this way it can be ensured that the vertical rails of the external framework are supported by the tie bars 12 in close proximity to, or even in light contact with, the outer face of the building but without bearing on the outer face of the building. It is important that the frame is not tightened against the building surface which may be constructed of an uneven or friable material. The tightening of the load nuts on the tie bars should not cause any of the rails of the external frame to bend or bow through contact between the rails and the building external walls at locations between the tie bars.

FIG. 7 illustrates a preferred shape of the outer pattress plate element 17*d* which may be cup-shaped, the better to contain and control the grout as it is extruded through the grout extrusion hole 17*e* as described above. The pattress plate element 17*d* of FIG. 7 comprises a flat portion 17*f* which may be for example 12 mm thick and a peripheral cylindrical flange portion 17*g* which projects perhaps 50 mm into the core hole drilled into the outer face of the building. Thus when the grout is injected into the space between the outer and inner pattress plate elements the final position of the outer pattress plate element may be proud of the outer face of the building by up to that 50 mm in order to prevent any part of the external framework from bearing against the outer face of the building.

The rails of the external metal framework which is attached to the building in accordance with this invention may be from 2 to 12 metres long, and it is desirable to prevent them from twisting, buckling or bending when the load nuts are tightened or when the external cladding is mounted thereon. Particularly in high rise buildings, wind battering or thermal movement can create considerable stresses on the framework and its supported cladding. The securing together of the fixing and locking plates by virtue of their cooperating profiles adds very considerably to the strength of the mounting for the external framework and its resistance to distortion due to wind battering and thermal stresses, but for further strength and rigidity it is desirable for the vertical and horizontal rails of the external framework to be attached to the building by smaller anchorages at fixing points between the protruding tie bar ends, preferably at spacings of about 50 cm. To achieve this, pilot holes are preferably formed at suitable spacings in the vertical and horizontal rails of the metal framework during fabrication. Then after mounting those vertical and horizontal rails by the method of this invention, but before mounting the external cladding panels, anchor holes can be drilled perpendicularly into the concrete walls of the building through those pilot holes, and anchorages inserted into the anchorage holes to support and secure the horizontal and vertical rails at spaced positions between the tie bars. Typically the pilot holes will be of a slightly greater diameter than the anchorage holes that are drilled, and of slightly greater diameter than threaded ends of the anchorages which pass through them in use, but that size difference is preferably compensated by adding a collared or flanged washer to fill the gaps between the anchorages and the pilot holes when the vertical and horizontal rails are connected to the building outer wall at the spaced anchorage points between the tie bars. Any gap between the vertical or horizontal rail and the external face of the building at any of the spaced apart anchorages may be filled by shim washers or spacers, or by adjustable pads mounted on threaded screws, when the anchorages are put in place.

All parts, including nuts, bolts, set screws and dowels, should be made from zinc plated or painted Grade 8.8 steel. Preferably the dowels 22*a* to 22*d* are simply tight friction fits into their mounting holes, but if the dowels are to be welded into their mounting holes then that welding should preferably be carried out in workshop conditions and by trained certified approved welding personnel, as cracks which could lead to structural failure are difficult to spot on-site.

FIG. 8 shows how the fixing plate may be formed from an integral part of a universal beam 32 which is one of the vertical rails forming the metal framework which will ultimately support the feature panels to be attached to a building being reinforced and optionally insulated. The front flanges and central web of that beam 32 are shown cut away to allow access to the rear flanges, and dowels 22 are set into dowel receiving holes to create a profiled outer face to that rear flange, corresponding to the flanges 22*a* to 22*d* of FIG. 2. The rear flange of the universal beam 32 thus forms the fixing plate through which the tie bar extends to secure the metal framework to the building. All other components of the assembly are numbered as in FIG. 2. No tie bar is shown in FIG. 8, but it will be understood that it passes through the oval hole shown in the universal beam 32 and through the hole 20 in the locking plate 18. Whereas the elongate slot 16 in FIG. 2 is substantially the same width as the tie bar 12 and the dowel receiving holes 24*a* to 24*j* in FIG. 2 are round holes to accept the dowels without lateral movement of the fixing and locking plates 14 and 18, some lateral movement is permitted in FIG. 8. The oval elongate slot 16 in FIG. 8 is wider than the tie bar, and the dowel receiving holes 24 are elongate, allowing some small sideways movement of the universal beam 32 relative to the tie bar and the locking plate 18. That permits some small adjustment from side to side of the vertical rails of the metal framework as they are secured to the outer wall of the building. Small variations in the positioning o the tie bars can therefore be accommodated. When the holding nuts (not illustrated in FIG. 8) are tightened as described in FIG. 2, the positions of the dowels 22 in selected dowel receiving holes 24 establishes the secure positioning of the metal framework in the vertical direction, and simple friction establishes the secure positioning of the metal framework in the horizontal direction. The holding nuts are therefore tightened to a predetermined torque rating just as described in GB 2574092, to establish that secure horizontal positioning.

FIG. 8 also shows a front plate 40 which is bolted to the front flanges of the universal beams 32 through preformed bolt holes 41 and 42. The front plate 40 would act to withstand the major stresses in the case of an internal explosion in the building, as any such explosion would tend to place the front plate in tension as the building wall was forced outwards. The front plate 40 spans the gap between the front flanges of the universal beams 32 but that gap may be made shorter than shown in FIGS. 8 and 9 by suitable shaping of the upper or lower one of the universal beams 32. For example the front flange of the upper universal beam 32 may overhang the rear flange of the lower universal beam 32, leaving a shorter space between the two universal beams 32 for the front plate 40 to span. The front flange of the upper universal beam 32 may even abut right up against the front flange of the lower universal beam 32, so that a very short front plate 40, bolted onto the universal beams 32 to span the abutting flanges, securely locks the two abutting flanges together. Although not illustrated, it will be understood that instead of the front plate shown in FIG. 8 which is bolted to the outwardly facing surfaces of the universal beams, the front flanges of each pair of adjacent universal beams 32 may be connected together by a pair of narrower connecting plates positioned below the front flanges and bolted to the universal beams one on each side of the central web. Even greater strength is possible if those connecting plates are replaced by suitable lengths of angle iron, bolted to the universal beams through the front flanges and to the universal beams and to each other through the central web.

Also shown in FIG. 8 are holes 45 and 46 pre-formed in the universal beams 32 at predefined spaced intervals. Those holes would not necessarily be as close to the ends of the universal beams as illustrated in FIG. 8, but would be at specified intervals of perhaps 400 or 500 mm apart. Of each pair of holes 45 and 46, the holes 45 are to receive the heads of bolt anchors which supplement the tie bars 12 to secure the metal framework to the building, and the holes 46 are simply access holes. After securing the metal framework to the building by holding nuts threaded to the tie bars as described above with reference to FIG. 2, additional intermediate support may be established by on-site drilling through the holes 45 and 46 into the external walls of the building, and inserting expanding metal bolts to obtain that additional anchorage. Preferably those anchor bolts extend through the outer skin of the building wall to an anchorage on the inner skin.

FIG. 8 illustrates how the universal beam of the metal framework may be partly cut away and provided with a profiled outer facing surface, to act as the fixing plate which is a necessary part of this invention. The profiling in FIG. 8 is a set of projecting dowels 22. If the same principle of cutting away part of the universal beam to use that beam as the fixing plate is extended to a corrugated profiled surface, then it is unlikely that suitable corrugations will be able to be formed directly in the metal of the universal beams. FIG. 9 illustrates how a corrugated profiled plate 14' can be secured to the front facing flange of the universal beam 32 to obtain the necessary profiling. The plate 14' may be made of any suitable metal or other strong and fire-resistant material and is secured to the vertical universal beams 32 of the metal framework for example by bolts passing through holes (unreferenced in FIG. 9) pre-formed in the beams 32 and plate 14'. Once secured, the corrugated front face of the plate 14' creates the profiled outwardly facing fixing plate face of the universal beam 32 against which the locking plate mates in use. All other elements of FIG. 9 are numbered as in FIG. 8, and the description of FIG. 8 applies. As with the other illustrated embodiments, the vertical and horizontal rail elements of the external metal framework may be adjusted as needed during installation and assembly, and lateral extensions of the fixing plates may be used to span large offsets to reach certain of the tie bars, just as in FIG. 6.

FIG. 9 uses the profiled fixing and locking plates to achieve secure and non-sliding connections between the external metal framework and the tie bars in one direction only (illustrated as the vertical direction) but relies on friction and correct tightening of the holding bolts for secure connections in the horizontal direction. FIG. 10 illustrates how profiled cooperating surfaces can provide secure and non-sliding anchorage in both directions. In FIG. 10 the fixing plate is formed in two parts: an inner plate portion 14*a* and an outer plate portion 14*b*. The inner plate portion 14*a* has profiled channels formed, for example by milling, in one direction and has a smooth rear face. The outer plate portion 14*b* has cooperating profiling on its rear face and has has profiled channels in the transverse direction on its front face. Both plate portions have a wide slot or cut-away portion 16 through which the tie bar passes when the structure is secured to the outer face of a building, the slot or cut-away portion 16 being substantially wider than the tie bar itself. If the fixing plate is fastened to a cut-away portion of the vertical rail 32 as in FIG. 9, that would be by bolts passing through bolt holes 50 in the inner plate portion. The locking plate of FIG. 9 would permit both vertical and horizontal adjustment of the beam 32 during installation, both adjustments being incremental as dictated by the cooperating corrugations on the facing grooved surfaces. On tightening the holding bolt, however, the assembly would be held securely in both the horizontal and vertical directions by those grooved surfaces.

The invention claimed is:

1. A method of securing a metal framework of aligned and mutually distanced vertical rails to an array of screw-threaded tie bar ends projecting from an outer wall of a building, the metal framework being suitable for subsequent attachment to an outer wall of an array of feature panels, which method comprises:

placing over each projecting tie bar end of the array of screw-threaded tie bar ends a fixing plate that has a profiled outer face, the tie bar end of the array of screw-threaded tie bar ends passing through a vertical or horizontal elongate slot formed in the respective fixing plate;

placing over each projecting tie bar end of the array of screw-threaded tie bar ends a locking plate that has a profiled inner face, the profiled inner face of each locking plate, and the outer face of the fixing plate, being complementary to one another so as to enable the two plates to mate with each other in a plurality of positions relative to one another, the projecting tie bar end of the array of screw-threaded tie bar ends passing through a circular hole in the locking plate;

adjusting a position of the fixing plate relative to the tie bar end of the array of screw-threaded tie bar ends to bring each fixing plate and locking plate to a horizontal or vertical alignment position;

securing together pairs of fixing and locking plates, with the fixing plate of each pair being held at the horizontal or vertical alignment position by mating profiles of the fixing and locking plates, by threading a holding nut onto each projecting tie bar end of the array of screw-threaded tie bar ends and tightening the holding nut against an associated locking plate; and securing the vertical rails of the metal framework to the pairs of fixing and locking plates by an array of bolts connecting each vertical rail to each fixing plate, wherein complementary profiles of the fixing plate and the locking plate are one or more dowels projecting from a profiled face of one of the fixing plate and the locking plate receivable in alternative dowel receiving holes in another of the fixing plate and the locking plate, and the circular hole in the or each locking plate is positioned asymmetrically relative to the one or more dowels or the alternative dowel receiving holes, so that inversion of that locking plate permits a further element of vertical or horizontal adjustability of a final positioning of a corresponding fixing plate relative to a corresponding tie bar end of the array of screw-threaded tie bar ends.

2. A method according to claim 1, wherein complementary profiles of the fixing plate and the locking plate are regular corrugations with peaks and troughs of the regular corrugations on the fixing plate matching peaks and troughs of the regular corrugations on the locking plate.

3. A method according to claim 2, wherein the regular corrugations have been created by milling or pressing parallel grooves into faces of the fixing plate and the locking plate.

4. A method according to claim 1, wherein the one or more dowels are provided on the fixing plate and the alternative dowel receiving holes are in the locking plate.

5. A method according to claim 1, wherein the one or more dowels are provided on the locking plate and the alternative dowel receiving holes are in the fixing plate.

6. A method according to claim 1, wherein each holding nut is tightened to a predetermined torque rating.

7. A method according to claim 1, wherein each holding nut is held in place by a locking nut.

8. A method according to claim 1, wherein the vertical or horizontal elongate slot through which the tie bar end of the array of screw-threaded tie bar ends passes is a vertical slot, making a selection of a position of the fixing plate relative to the locking plate on tightening the holding nut a selection which determines a vertical alignment of the fixing plate.

9. A method according to claim 1, wherein the vertical or horizontal elongate slot through which the tie bar end of the array of screw-threaded tie bar ends passes is a horizontal slot, making a selection of a position of the fixing plate relative to the locking plate on tightening the holding nut a selection which determines a horizontal alignment of the fixing plate.

10. A method according to claim 9, wherein the horizontal elongate slot in the fixing plate is a slot formed in a laterally extending wing of the fixing plate.

* * * * *